US012433439B2

(12) United States Patent
Xu et al.

(10) Patent No.: US 12,433,439 B2
(45) Date of Patent: Oct. 7, 2025

(54) CHRISTMAS TREE WITH ROTATABLE DECORATIVE LAMP

(71) Applicant: Dongyang Shusheng Crafts Co., Ltd., Jinhua (CN)

(72) Inventors: Gaohua Xu, Jinhua (CN); Yucheng Wang, Jinhua (CN)

(73) Assignee: Dongyang Shusheng Crafts Co., Ltd., Jinhua (CN)

( * ) Notice: Subject to any disclaimer, the term of this patent is extended or adjusted under 35 U.S.C. 154(b) by 144 days.

(21) Appl. No.: 18/478,959

(22) Filed: Sep. 29, 2023

(65) Prior Publication Data

US 2025/0031891 A1 Jan. 30, 2025

(30) Foreign Application Priority Data

Jul. 25, 2023 (CN) ..... 202321964598.7

(51) Int. Cl.
*A47G 33/08* (2006.01)

(52) U.S. Cl.
CPC .. *A47G 33/0809* (2013.01); *A47G 2033/0827* (2013.01); *A47G 2033/089* (2013.01)

(58) Field of Classification Search
CPC . A47G 33/0809; A47G 33/089; A47G 33/126
See application file for complete search history.

(56) References Cited

U.S. PATENT DOCUMENTS 2,605,386 A * 7/1952 Syretz ..... A47G 33/0809 362/249.17
2,724,926 A * 11/1955 Fisher ..... A47G 33/0809 428/3
3,594,934 A * 7/1971 Burnbaum ..... A47G 33/0809 40/430

FOREIGN PATENT DOCUMENTS

CN 214905781 U 11/2021
CN 217118111 U 12/2021
CN 216345589 U 4/2022
CN 217243709 U 8/2022

* cited by examiner

*Primary Examiner* — Adam Krupicka

(57) ABSTRACT

The present disclosure provides a Christmas tree ornament, aiming to provide a Christmas tree with a rotatable decorative lamp. The key points of the technical solution are that the Christmas tree includes a tree body and a rotatable lighting unit positioned on an upper end of the tree body. The rotatable lighting unit includes a housing, a drive motor fixedly mounted inside the housing, a transmission gear component moveably mounted inside the housing and a rotatable lamp moveably mounted on the housing. The drive motor is provided thereon with a transmission shaft connected thereto in a transmission manner. The transmission shaft has an upper end fixedly connected to a lower gear. The lower gear is provided on one side with the transmission gear component connected thereto in a transmission manner. The lower gear has an upper end sleeved with a dedicated inner sheath.

6 Claims, 4 Drawing Sheets

CHRISTMAS TREE WITH ROTATABLE DECORATIVE LAMP

CROSS-REFERENCE TO RELATED APPLICATIONS

The application claims priority to Chinese patent application No. 202321964598.7, filed on Jul. 25, 2023, the entire contents of which are incorporated herein by reference.

TECHNICAL FIELD

The present disclosure relates to a Christmas tree ornament, more particularly to a Christmas tree with a rotatable decorative lamp.

BACKGROUND

At present, fiber-optic Christmas tree and lamp tree series products prevailing on the market are all manufactured in such a way that each branch on a tree body guides LED light emitting tubes and fibers from a top of the branch to a root of the tree body through an interior of the branch, then a power supply connector is lead out from inside the tree body to switch on all the LED light emitting tubes on the tree body, and next a light source arranged inside a base is employed to illuminate the fibers at the bottom of the tree body so that the fibers inside the tree body can light. All the manufacturing methods follow the same pattern, which, however, cannot achieve the rotation of a decorative lamp on the top of the Christmas tree.

The prior art, for example, Chinese application "Magnetic suspension Christmas tree" with patent No. CN217118111U (application No. 202123152696.4) specifically includes a Christmas tree, a base fixedly mounted at a bottom of the Christmas tree and a tray positioned below the base. The base includes a levitation magnet, a wireless powered receiving coil, a voltage stabilizing chip and a lighting strip. The wireless powered receiving coil, the voltage stabilizing chip and the lighting strip are connected in sequence. The lighting strip is wound on an exterior surface of the Christmas tree. The tray includes a housing and a wireless powered switch, a circuit input module, a voltage stabilizing circuit board, a ring magnet and a wireless powered transmitting coil that are all mounted inside the housing. The wireless powered switch, the circuit input module, the voltage stabilizing circuit board and the wireless powered transmitting coil are all electrically connected in sequence. The wireless powered transmitting coil is paired with the wireless powered receiving coil, for transmission of wireless electricity. The ring magnet and the levitation magnet form a magnetic repulsion match.

Although the above technical solution can achieve the rotation of the entire Christmas tree, whereby achieving the rotation of the decorative lamp of the Christmas tree from another perspective, the technical solution is merely applicable for small sized Christmas trees. Those Christmas trees with large volume and weight are difficult to rotate entirely, thus being unable to achieve the rotation of the decorative lamp.

SUMMARY

In view of the shortcomings of the existing technologies, the present disclosure aims to provide a Christmas tree with a rotatable decorative lamp.

In order to achieve the above aim, the present disclosure provides the following technical solution. A Christmas tree with a rotatable decorative lamp includes a tree body and a rotatable lighting unit positioned on an upper end of the tree body. The rotatable lighting unit includes a housing, a drive motor fixedly mounted inside the housing, a transmission gear component moveably mounted inside the housing and a rotatable lamp moveably mounted on the housing. The drive motor is provided thereon with a transmission shaft connected thereto in a transmission manner. The transmission shaft has an upper end fixedly connected to a lower gear. The lower gear is provided on one side with the transmission gear component connected thereto in a transmission manner. The lower gear has an upper end sleeved with a dedicated inner sheath. A cylindrical sleeve member runs through a middle part of the dedicated inner sheath. A shaft sleeve with a through hole is fixedly connected inside the cylindrical sleeve member. A first magnetic connector is mounted inside the through hole of the shaft sleeve through a bearing. The cylindrical sleeve member is further fixedly connected to an upper gear that has the same diameter as the cylindrical sleeve member and is connected to the transmission gear component in a transmission manner. The rotatable lamp includes a column body that can be fixed to the shaft sleeve through clamping. The column body has a bottom surface fixedly connected to a second magnetic connector and an upper end fixedly connected to a decorative lamp. The first magnetic connector and the second magnetic connector are magnetic male and female connectors mated with one another.

Further, in the present disclosure, the transmission gear component is composed of a first gear, a connecting shaft and a second gear. The first gear and the second gear are concentrically and fixedly connected to upper and lower ends of the connecting shaft. The first gear is engaged with the upper gear in a transmission manner; and the second gear is engaged with the lower gear in a transmission manner.

Further, in the present disclosure, the dedicated inner sheath is provided thereon with a support column that is integrally formed and coaxial with the connecting shaft. The support column has a bottom end fixedly connected to a support bearing that is sleeved on a top of the connecting shaft and positioned above the first gear.

Further, in the present disclosure, below the rotatable lighting unit are provided an optical charging panel and a storage power supply that are connected to one another. The storage power supply is electrically connected to the first magnetic connector and the drive motor.

Further, in the present disclosure, a connecting wire for connecting to the decorative lamp is provided inside the second magnetic connector.

Further, in the present disclosure, the decorative lamp is of a five-pointed star structure having an internal lighting source.

The present disclosure has the following beneficial effects.

The technical solution drives the rotation of the transmission gear component and the rotatable lamp through the drive motor, thereby causing the rotation of the decorative lamp, so that the decorative lamp on the upper end of the Christmas tree can be lighted and rotated without rotating the entire Christmas tree, enhancing the fun of the product.

Figure 1:
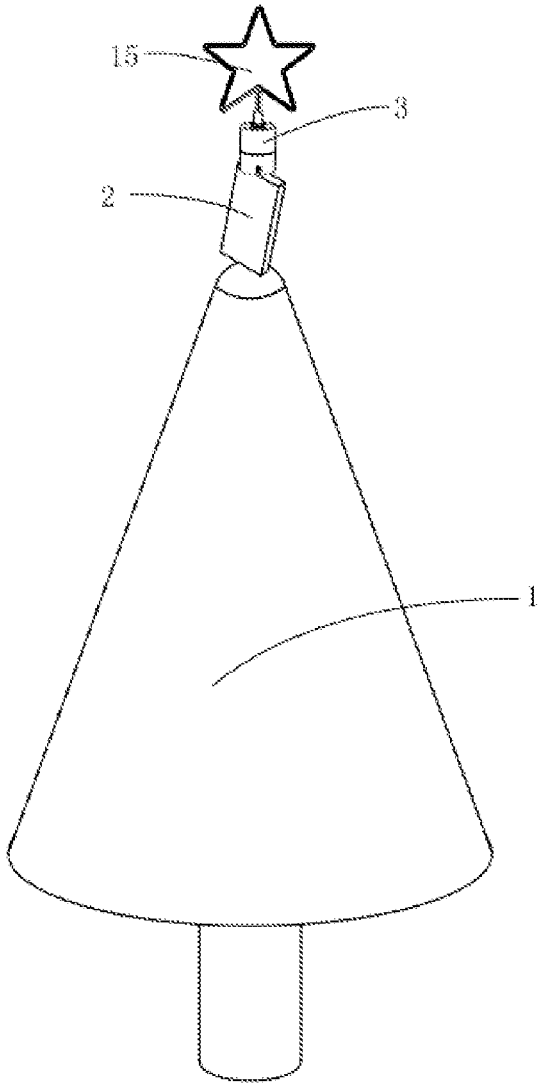
FIG. 1 is a structure diagram of a Christmas tree with a rotatable decorative lamp according to the present disclosure.
Figure 2:
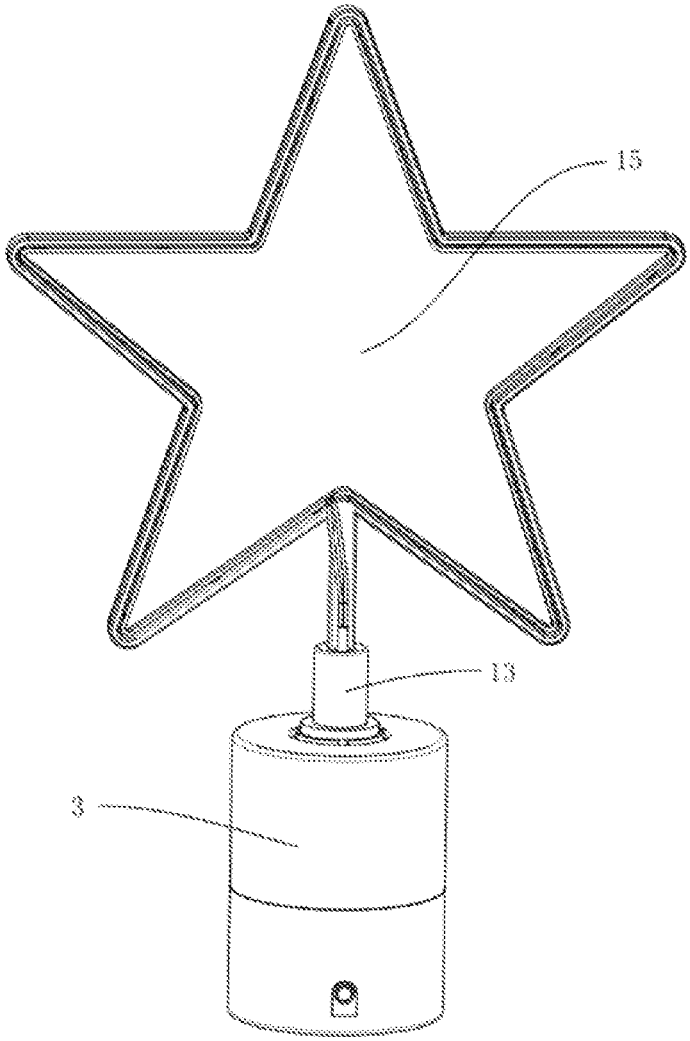
FIG. 2 is a structure diagram of a rotatable lighting unit of a Christmas tree with a rotatable decorative lamp according to the present disclosure.
Figure 3:
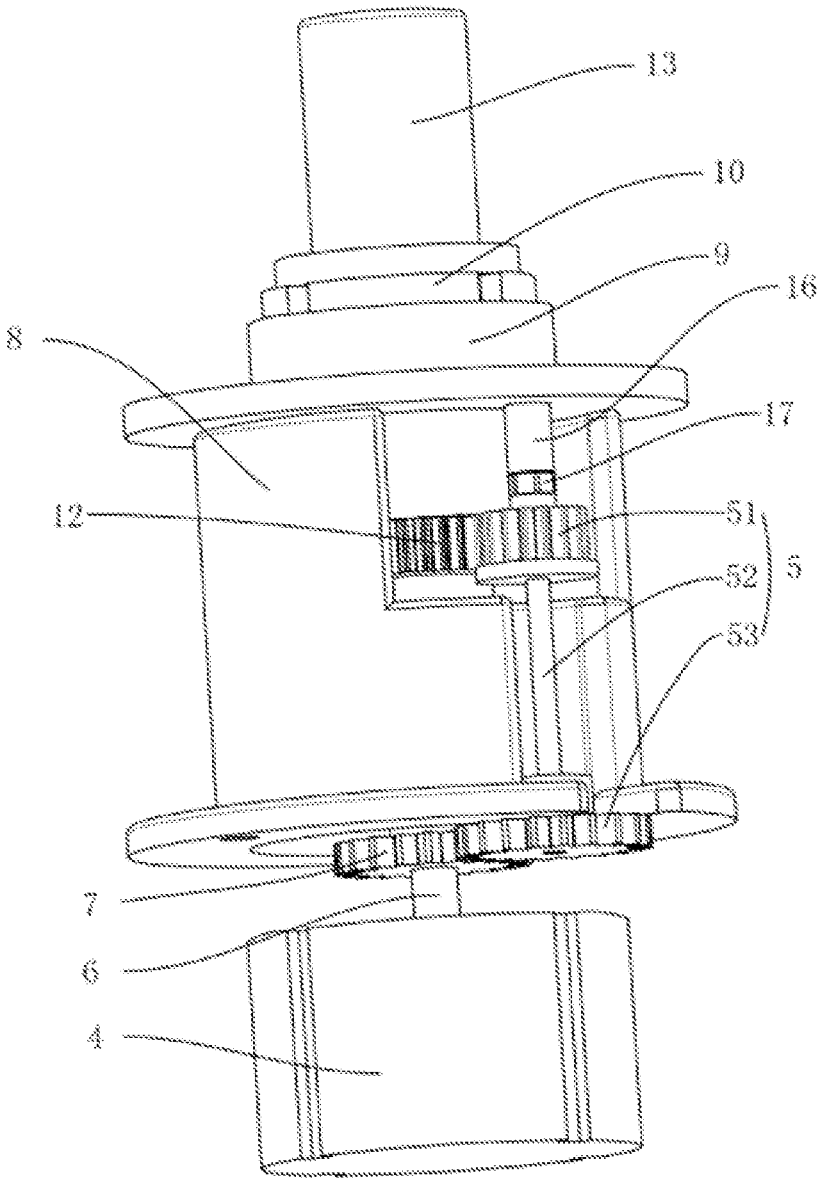
FIG. 3 is a partial internal structure diagram of a rotatable lighting unit of a Christmas tree with a rotatable decorative lamp according to the present disclosure.
Figure 4:
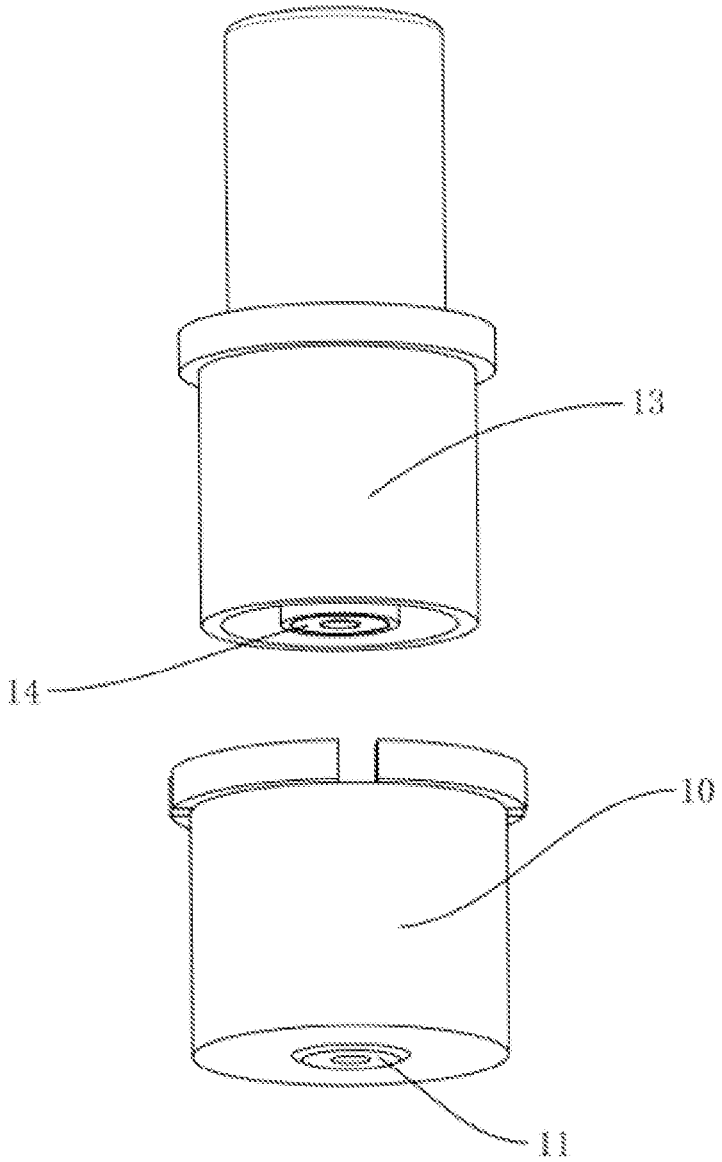
FIG. 4 is a structure diagram of a shaft sleeve and a column body of a Christmas tree with a rotatable decorative lamp according to the present disclosure.

Designators on FIG. 1 to FIG. 4 are as described below: 1, a tree body; 2, an optical charging panel; 3, a housing; 4, a drive motor; 5, a transmission gear component; 51, a first gear; 52, a connecting shaft; 53, a second gear; 6, a transmission shaft; 7, a lower gear; 8, a dedicated inner sheath; 9, a cylindrical sleeve member; 10, a shaft sleeve; 11, a first magnetic connector; 12, an upper gear; 13, a column body; 14, a second magnetic connector; 15, a decorative lamp; 16, a support column; and 17, a support bearing.

DETAILED DESCRIPTION OF THE EMBODIMENTS

Embodiments of the Christmas tree with a rotatable decorative lamp of the present disclosure are described below in further detail by reference to FIG. 1 to FIG. 4.

To ease illustration, relative spatial terms such as "above", "below", "left", "right", etc. are employed in the embodiments to illustrate the relationship of one element or feature shown on the drawings relative to another element or feature. It should be understood that besides the orientation shown on the drawings, the spatial terms are intended to cover different orientations of a device in usage or operation. For example, if a device on the drawings is inverted, the element which is described as positioned "below" other elements or features will be positioned "above" the other elements or features. As a result, the exemplary term "below" may include both orientations of above and below. The device can be positioned by other ways (rotating 90 degrees or being positioned in other orientations), and the relative spatial terms used herein may be explained accordingly.

Furthermore, relationship terms such as "first", "second", etc. are merely employed to distinguish one component from another component having the same name, rather than necessarily requiring or implying there is any such actual relationship or sequence between those components.

Referring to FIG. 1 to FIG. 4, a Christmas tree with a rotatable decorative lamp includes a tree body 1 and a rotatable lighting unit positioned on an upper end of the tree body 1. The rotatable lighting unit includes a housing 3, a drive motor 4 fixedly mounted inside the housing 3, a transmission gear component 5 moveably mounted inside the housing 3 and a rotatable lamp moveably mounted on the housing 3. The drive motor 4 is provided thereon with a transmission shaft 6 connected thereto in a transmission manner. The transmission shaft 6 has an upper end fixedly connected to a lower gear 7. The lower gear 7 is provided on one side with the transmission gear component 5 connected thereto in a transmission manner. The lower gear 7 has an upper end sleeved with a dedicated inner sheath 8. A cylindrical sleeve member 9 runs through a middle part of the dedicated inner sheath 8. A shaft sleeve 10 with a through hole is fixedly connected inside the cylindrical sleeve member 9. A first magnetic connector 11 is mounted inside the through hole of the shaft sleeve 10 through a bearing. The cylindrical sleeve member 9 is formed with a through hole at a bottom thereof, for electrical connection between a storage power supply and the first magnetic connector 11. The cylindrical sleeve member 9 is further fixedly connected to an upper gear 12 that has the same diameter as the cylindrical sleeve member 9 and is connected to the transmission gear component 5 in a transmission manner. The rotatable lamp includes a column body 13 that can be fixed to the shaft sleeve 10 through clamping. The column body 13 has a bottom surface fixedly connected to a second magnetic connector 14 and an upper end fixedly connected to a decorative lamp 15. The first magnetic connector 11 and the second magnetic connector 14 are magnetic male and female connectors mated with one another. The transmission gear component 5 is composed of a first gear 51, a connecting shaft 52 and a second gear 53. The first gear 51 and the second gear 53 are concentrically and fixedly connected to upper and lower ends of the connecting shaft 52. The first gear 51 is engaged with the upper gear 12 in a transmission manner; and the second gear 53 is engaged with the lower gear 7 in a transmission manner. The dedicated inner sheath 8 is provided thereon with a support column 16 that is integrally formed and coaxial with the connecting shaft 52. The support column 16 has a bottom end fixedly connected to a support bearing 17 that is sleeved on a top of the connecting shaft 52 and positioned above the first gear 51. Below the rotatable lighting unit are provided an optical charging panel 2 and a storage power supply that are connected to one another, and the storage power supply is electrically connected to the first magnetic connector 11 and the drive motor 4. A connecting wire for connecting to the decorative lamp 15 is provided inside the second magnetic connector 14. The decorative lamp 15 is of a five-pointed star structure having an internal lighting source.

Compared to the existing technology, the present disclosure drives the rotation of the transmission gear component 5 and the rotatable lamp through the drive motor 4, thereby causing the rotation of the decorative lamp 15, so that the decorative lamp 15 on the upper end of the Christmas tree can be lighted and rotated without rotating the entire Christmas tree, enhancing the fun of the product.

The operating principle is as follows. The transmission shaft 6 is driven to rotate by the drive motor 4, and the transmission shaft 6 drives the upper gear 12 to rotate through the transmission gear component 5. Then, the rotation of the upper gear 12 drives the cylindrical sleeve member 9 to rotate, the rotation of the cylindrical sleeve member 9 drives the shaft sleeve 10 to rotate, the rotation of the shaft sleeve 10 drives the column body 13 to rotate, and the rotation of the column body 13 drives the decorative lamp 15 to rotate, whereby achieving the rotation of the decorative lamp 15 on the upper end of the Christmas tree.

The above are preferred embodiments of the present disclosure merely and the present disclosure is not limited thereto. General changes and substitutions made within the scope of the technical solution of the present disclosure by those skills in the art are all intended to be included within the scope of protection of the present disclosure.

What is claimed is:

1. A Christmas tree with a rotatable decorative lamp, comprising a tree body (1) and a rotatable lighting unit positioned on an upper end of the tree body (1), the rotatable lighting unit comprising a housing (3), a drive motor (4) fixedly mounted inside the housing (3), a transmission gear component (5) moveably mounted inside the housing (3) and a rotatable lamp moveably mounted on the housing (3), wherein the drive motor (4) is provided with a transmission shaft (6) connected in a transmission manner; an upper end of the transmission shaft (6) is fixedly connected to a lower gear (7); one side of the lower gear (7) is provided with the transmission gear component (5) connected in a transmission manner; an upper end of the lower gear (7) is sleeved with a dedicated inner sheath (8); a cylindrical sleeve member (9) runs through a middle part of the dedicated inner sheath (8); a shaft sleeve (10) with a through hole is fixedly connected inside the cylindrical sleeve member (9); a first magnetic connector (11) is mounted inside the through hole of the shaft sleeve (10) through a bearing; the cylindrical sleeve member (9) is further fixedly connected to an upper gear (12) that has the same diameter as the cylindrical sleeve member (9) and is connected to the transmission gear component (5) in a transmission manner; the rotatable lamp comprises a column body (13) fixed to the shaft sleeve (10) through clamping; a bottom surface of the column body (13) is fixedly connected to a second magnetic connector (14) and an upper end of the column body (13) is fixedly connected to a decorative lamp (15); and the first magnetic connector (11) and the second magnetic connector (14) are magnetic male and female connectors mated with one another.

2. The Christmas tree with the rotatable decorative lamp according to claim 1, wherein the transmission gear component (5) is composed of a first gear (51), a connecting shaft (52) and a second gear (53); the first gear (51) and the second gear (53) are concentrically and fixedly connected to upper and lower ends of the connecting shaft (52); the first gear (51) is engaged with the upper gear (12) in a transmission manner; and the second gear (53) is engaged with the lower gear (7) in a transmission manner.

3. The Christmas tree with the rotatable decorative lamp according to claim 2, wherein the dedicated inner sheath (8) is provided with a support column (16) that is integrally formed and coaxial with the connecting shaft (52); and the support column (16) has a bottom end fixedly connected to a support bearing (17) that is sleeved on a top of the connecting shaft (52) and positioned above the first gear (51).

4. The Christmas tree with the rotatable decorative lamp according to claim 1, wherein below the rotatable lighting unit are provided an optical charging panel (2) and a storage power supply that are connected to one another, and the storage power supply is electrically connected to the first magnetic connector (11) and the drive motor (4).

5. The Christmas tree with the rotatable decorative lamp according to claim 1, wherein a connecting wire for connecting to the decorative lamp (15) is provided inside the second magnetic connector (14).

6. The Christmas tree with the rotatable decorative lamp according to claim 1, wherein the decorative lamp (15) is of a five-pointed star structure having an internal lighting source.

* * * * *